United States Patent [19]

Davis et al.

[11] Patent Number: 4,907,429

[45] Date of Patent: Mar. 13, 1990

[54] REMOTE CONTROLLED DOOR LOCK APPARATUS

[76] Inventors: Kenneth Davis, 166-26 Powells Cove Blvd., Whitestone, N.Y. 11357; Norman Anderson, 2626 E. 28th St., Brooklyn, N.Y. 11235

[21] Appl. No.: 136,028

[22] Filed: Dec. 21, 1987

Related U.S. Application Data

[63] Continuation-in-part of Ser. No. 453,754, Dec. 27, 1982, abandoned.

[51] Int. Cl.[4] ..... E05B 47/00

[52] U.S. Cl. ..... 70/279; 70/282; 70/DIG. 48; 200/81 R; 292/144

[58] Field of Search ..... 200/83 Z, 81 R; 70/257, 70/DIG. 30, 277, 279, 282, 275, DIG. 48; 292/144, 201

[56] References Cited

U.S. PATENT DOCUMENTS

| | | | |
|---|---|---|---|
| 1,563,198 | 11/1925 | Ledbetter | 70/282 |
| 2,715,348 | 8/1955 | Williams | 200/81.4 |
| 3,197,984 | 8/1965 | Cohen | 70/271 |
| 3,354,677 | 11/1967 | Green | 70/279 |
| 3,751,088 | 8/1973 | Schlage et al. | 70/281 X |
| 3,890,646 | 6/1975 | Fassett et al. | 200/83 Z X |
| 3,946,174 | 3/1976 | Herbst | 200/83 Z X |
| 4,086,458 | 4/1978 | Dickey | 200/85 R |
| 4,117,863 | 10/1978 | Gabus | 200/81 R X |
| 4,170,374 | 10/1979 | Garcia | 292/201 |
| 4,509,347 | 4/1985 | Young | 70/279 X |

FOREIGN PATENT DOCUMENTS

| | | | |
|---|---|---|---|
| 1323587 | 3/1963 | France | 70/282 |

*Primary Examiner*—Lloyd A. Gall
*Attorney, Agent, or Firm*—Evelyn M. Sommer

[57] ABSTRACT

A remote controlled door lock apparatus is provided for use in connection with a conventional door lock. The apparatus includes a solenoid operated element for mounting on the door and for connection to the door lock, and a remote control element for connection to the solenoid element for remotely locking and unlocking the door lock.

3 Claims, 2 Drawing Sheets

REMOTE CONTROLLED DOOR LOCK APPARATUS

RELATED APPLICATION

This application is a continuation-in-part of application Serial No. 453,754, filed Dec. 27, 1982, now abandoned.

REMOTE CONTROLLED DOOR LOCK APPARATUS

The present invention is directed to an apparatus for remote control of the unlocking of a door and, more particularly, to an apparatus adapted to be readily connected to a conventional door lock to enable one to remotely control the locking and unlocking of that door lock.

BACKGROUND OF THE INVENTION

The physically handicapped and other disabled individuals often are faced with the need to unlock a normally locked door, as for example the front door of a home, when that individual is in a remote location, such as a bedroom, in the home. Clearly, there has, heretofore, been needed a mechanism to enable such a disabled individual, or simply anyone who is unwilling to move from the remote location, to unlock and/or lock the doorlock of the front door of the home or business.

Further, before the present invention there was needed an apparatus which remotely operates an existing, conventional lock of a door without in any way changing the lock or in any way disabling the normal operation of the lock. Still further, there was a need for such an apparatus which could also be installed easily and without any damage to the lock.

SUMMARY OF THE INVENTION

It is an object of the present invention to provide an apparatus which remotely controls a conventional door lock.

It is another object of the present invention to provide such an apparatus which is relatively inexpensive and simple to install.

It is yet another object of the present invention to provide such an apparatus which is relatively simple to use and which does not interfere with the normal operation of the conventional lock.

It is still yet another object of the present invention to provide such an apparatus which enables one to operate the lock directly, as well as remotely.

In accordance with the principles of the present invention, there is provided an apparatus which is adapted for use with a door lock that has a hand lever which is placed in a first position to lock the door lock and which is placed in a second position to unlock the door lock. The lock also has a conventional key mechanism which is also used to lock and unlock the door lock. Accordingly, this conventional lock has the key mechanism on the side of the lock located outside the building; while the lock lever is on the side of the lock, opposite the key mechanism, located inside the building. Should the lock have merely a slide button or knob or quarter-turn knob instead of a hand lever, a hand lever can be fastened to that button or knob by conventional means.

The apparatus includes first means adapted to be secured to the door and connected to the lever. The first means has first and second mutually exclusive electric states. The first means, when in its first state, places the lever in its first position and, when in its second state, places the lever in its second position.

The apparatus also includes second means adapted to be positioned at a remote location with respect to the first means, and under the control of the operator. The second means is coupled to the first means, and also has first and second mutually exclusive states of operation. The first and second states of operation of the second means correspond to the first and second states, respectively, of operation of the first means. The operator controls the placement of the second means in either one of its two states of operation. The second means, when placed in either one of its states of operation, causes the first means to be placed in its corresponding state.

DETAILED DESCRIPTION OF PREFERRED EMBODIMENTS

Figure 1:
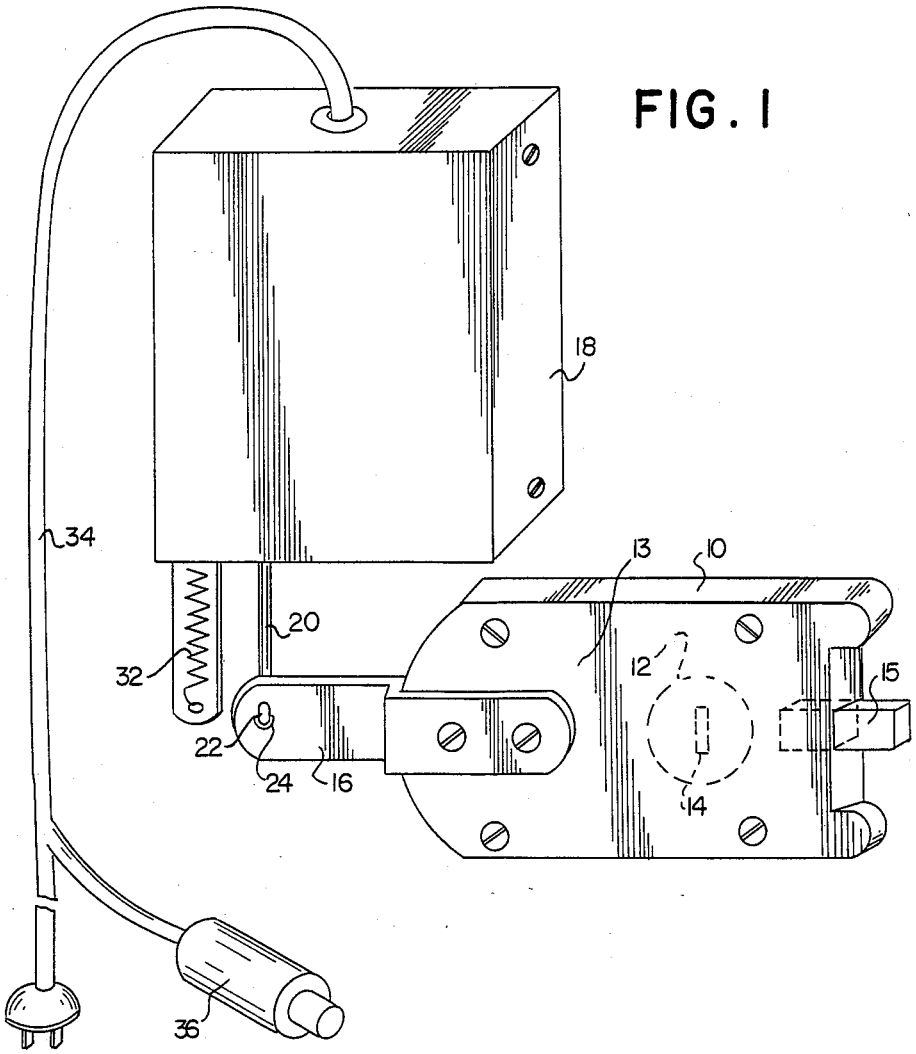
FIG. 1 is a diagrammatic view of the apparatus of the present invention connected to the hand lock lever of a conventional lock.

Referring now to the Figures and in particular FIG. 1, there is shown a conventional door lock generally represented by reference numeral 10. Door lock 10 has, on one side thereof, a key mechanism including a key cylinder 12 with a key slot 14 by which the door lock 10 can be locked or unlocked in conventional manner by use of a key (not shown). The other side of the door lock 10 is provided with a hand lever 16 which can be manually moved by the operator to also lock or unlock the door lock 10 in the conventional manner.

To effect the conventional unlocking and/or locking of the door lock 10, the door lock basically consists of known internal linkage represented schematically by reference numeral 13 which connects both the hand lever 16 and cylinder 12 to bolt 15 of the door lock 10. Accordingly, the operator can use either hand lever 16 or key cylinder 12 with key slot 14 to activate the linkage 13 which moves bolt 15 back and forth between a retracted position wherein the bolt 15 is basically in the door lock 10 so as to unlock the door as shown in dotted lines in FIG. 1, to another or fully extended position wherein the bolt 15 is mostly outside of the door lock 10 so as to lock the door as shown in solid lines in FIG. 1. The side of the lock which has the key mechanism is normally located on the door side which is outside of a building, while the side of the lock which has the hand lever 16 is normally located on the door side which is inside the building. However, such a door lock can also be applied to doors within the building.

As with any conventional door lock, linkage 13 provides conventional, known means for overriding either the key mechanism or the hand lever should the other be activated by the operator.

The apparatus of the present invention includes a unit or housing 18 which can readily be secured to a door by conventional means, such as screws and bolts. Unit 18 has a linkage 20 which extends downwardly from the unit, and linkage 20 has a lower or free end 22. In the embodiment shown in FIG. 1, free end 22 has a hook configuration which is adapted to be inserted into a hole 24 provided in the free end of hand lever 16. Free end 22 can be of any configuration provided it provides some means for attachment to hand lever 16. Further, linkage 20 can be an integral piece, or two or more pieces which are adjustably connected together.

Figure 3:
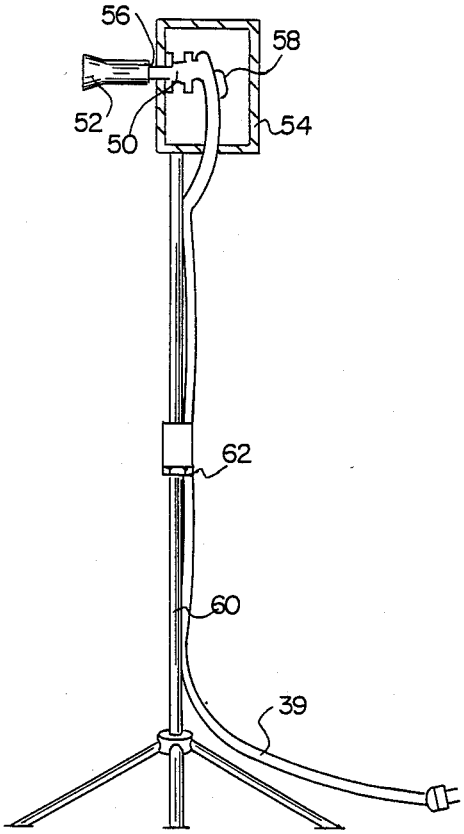
FIG. 3 is a detail view of one embodiment of the switch mechanism of the present invention.
Figure 2:
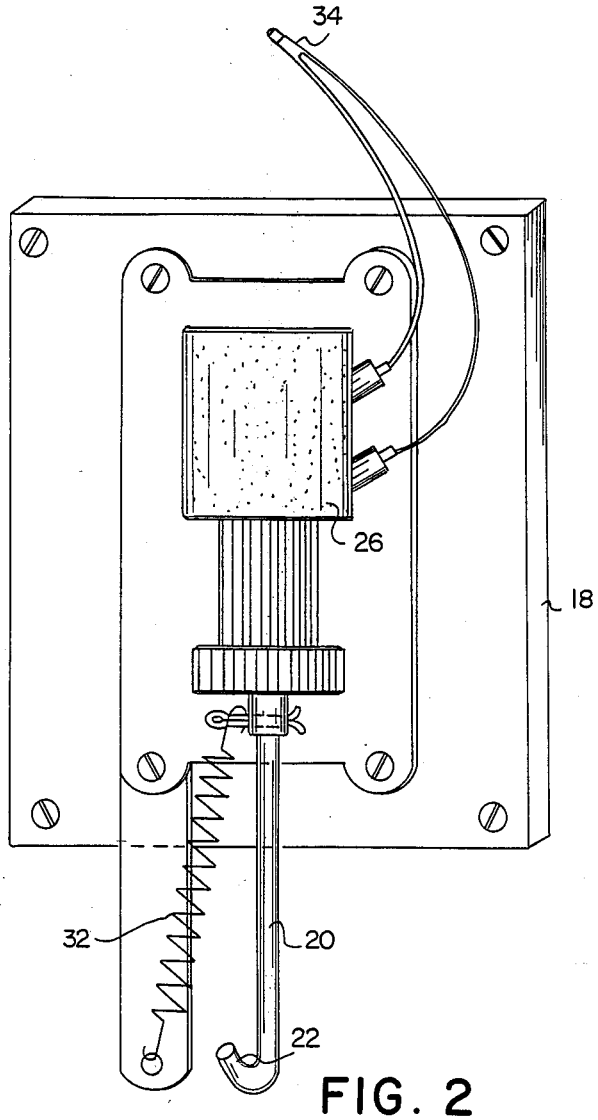
FIG. 2 is a partial sectional view of unit 18 shown in FIG. 1.

The unit 18 also contains, as shown in FIG. 2, on the inside thereof, a solenoid 26 comprising a coil 28 and a magnetic core 30 connected to the coil and adapted to move in the coil. As shown in FIG. 3, magnetic core 30 is secured to the linkage 20. When the solenoid is in its normal, or de-energized, state (first electric state), the linkage 20 is moved to its fully extended downward position so that hand lever 16 is moved to its locked position. A return spring 32 maintains or holds the linkage 20 in this position. When the solenoid 26 is moved to its energized state (second electric state), magnetic core 30 moves upward to move the linkage 20 upward so that the hand lever 16 is placed in its unlocked position. As soon as the solenoid is de-energized, the linkage is returned to its original position and the door is again locked.

The apparatus of the present invention may be used in conjunction with any conventional lock which has some type of button or knob or lever on one side of the lock, that is the side of the lock normally placed on the inside of the building. Specifically, if a knob or button is used, all that is needed is to attach a hand lever analogous to hand lever 16 shown to the knob or button, and then connect the apparatus to that lever as discussed herein.

Figure 4:
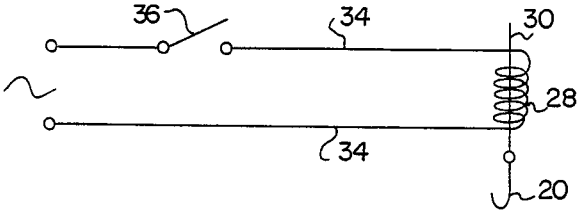
FIG. 4 is a circuit diagram of the circuitry of one embodiment of the present invention.

The solenoid 26 is connected via two conductor cables 34 to remotely disposed manually operated switch represented by reference numeral 36 in the circuit diagram of FIG. 4. Switch 36, when closed, forms an electrical circuit with the solenoid 26 and a suitable wall or floor socket (not shown). The wall or floor socket is a suitable source of electricity, as for example, a typical single phase 120 volt, 60 Hertz alternating current source.

The electricity receiving switch 36, or second means, has a first state of operation in which the switch is in its open position, shown in FIG. 4, and has a second state of operation (not shown) in which the switch is closed so that electricity is permitted to flow through the circuit shown in FIG. 4. When the switch 36 is in its first or open state, solenoid 26 is in its de-energized state so that linkage 20 is fully extended downward, as shown in FIG. 1, and hand lever is its locked position so that bolt 15 is in its locked or fully extended position. When the switch 36 is placed in its second state or closed position, electricity flows through the circuit into solenoid 26 so that the core 30 of the solenoid moves upward thereby causing hand lever 16 to swing or move upwards so that bolt 15 is in its unlocked or retracted position.

The switch 36 can be a conventional two position toggle switch or can be a push button operated switch which is normally open and is momentarily closed when the button is depressed. Further, switch 36 can be any special type of switch required by the special needs of the operator.

As another embodiment, one such switch 36 can be a pressure operated switch 50 shown in FIG. 3. Switch 50, which is normally opened, is closed when an operator applies pressure on the switch by exhaling or blowing through mouthpiece 52 onto the switch 50. As shown in FIG. 3, the switch 50 can be disposed in an insulated housing 59. There may be provided on housing 59, means, such as a clamp 56, which enables mouthpiece 52 to be removably attached to the housing so as to provide for removal or replacement of the mouthpiece. The switch 50 can be connected to a cable 39 via a suitable overload protector 58, and the cable, can be supported on a suitable stand 60 which stand is adjustable in height by conventional means, such as screw 62, can be connected to a suitable wall or floor electric outlet as discussed above.

In place of the 120 volt, 60 Hertz alternating currrent, a step down transformer can reduce the current to low voltage. The device of the invention can also be battery operated as well as operated by any of the conventional, available remote control means.

Although certain embodiments have been described and illustrated, modification may be made, as by adding, combining, subdividing parts or substituting equivalents while retaining the advantages and benefits of the present invention which is defined in the following claims.

Wherefore I claim:

1. An apparatus for use with a door lock mounted on a door having a hand lever and a key mechanism for moving a lock bolt of said door lock between a locked condition and an unlocked condition, comprising:

override means connected to said hand lever and said key mechanism for allowing said hand lever to override said key mechanism to lock and unlock said lock bolt, said hand lever having a first position in which said lock bolt is in its locked condition and a second position in which said lock bolt is in its unlocked condition solenoid means including a coil with a movable magnetic core, and a linkage, said linkage being secured at one end to said core and at the other end to said hand lever, wherein said core, when no current flows through said solenoid means, is at its rest position so that said hand lever is in its first position, and wherein said core, when current flows through said solenoid means, moves to its operative position so that said linkage moves said hand lever to its second position; and operator control means, disposed remotely from said door, connected by a conductor cable to said solenoid means and connected by plug means to a source of electrical energy, said operator control means including a mouthpiece switch located in close proximity to said mouthpiece, said switch being normally at a first, opened position at which current cannot flow from said source to said solenoid means and, when pressure from an operator exhaling through said mouthpiece is applied to said switch, said switch moves to a second, closed position at which current can flow from said source to said solenoid means, whereby said operator control means and said solenoid means connected by said linkage to said hand lever are used to override said key mechanism to remotely unlock said lock bolt of said door lock by said operator exhaling through said mouthpiece at a position remote from said door.

2. The apparatus of claim 1, further including an enclosed insulating housing for housing said switch.

3. The apparatus of claim 2, wherein said housing includes retaining means for removably retaining said mouthpiece to said housing in close proximity to said switch.

* * * * *